US005687430A

United States Patent [19]

Itai

[11] Patent Number: 5,687,430

[45] Date of Patent: Nov. 18, 1997

[54] PERFUMED URINE COLLECTION VESSEL FOR MEN AND WOMEN

[76] Inventor: Mieko Itai, Oaza Kannawa 999-6, Beppu City, Oita Pref., Japan

[21] Appl. No.: 287,287

[22] Filed: Aug. 5, 1994

[51] Int. Cl.[6] ..... A47K 11/12

[52] U.S. Cl. ..... 4/144.2; 4/144.1; 4/144.3; 4/453; 4/484

[58] Field of Search ..... 4/144.1, 144.2, 4/144.3, 452, 453, 484

[56] References Cited

U.S. PATENT DOCUMENTS

| | | | |
|---|---|---|---|
| 622,631 | 4/1899 | Orbeton | 4/144.3 |
| 1,337,829 | 4/1920 | Doyle | 4/144.1 |
| 3,070,810 | 1/1963 | Jones | 4/144.2 X |
| 3,163,869 | 1/1965 | Johnson et al. | 4/144.1 |
| 3,335,714 | 8/1967 | Giesy | 4/144.3 X |
| 3,419,913 | 1/1969 | Crosby | 4/452 |
| 3,471,869 | 10/1969 | Segal | 4/453 |
| 4,117,845 | 10/1978 | Brown | 4/144.1 X |
| 4,309,779 | 1/1982 | Knight | 4/144.1 X |

FOREIGN PATENT DOCUMENTS

| | | | |
|---|---|---|---|
| 0549850 | 7/1993 | European Pat. Off. | 4/144.1 |

*Primary Examiner*—Robert M. Fetsuga

[57] ABSTRACT

A commode for men and women including a waste collection vessel having an opening shaped to conform to a user's body for receiving waste discharge. A perfumed sheet and vinyl bag are disposed within said vessel. An annular packing ring has a diameter to be sealingly received in, and clamp a mouth portion of the bag to, the vessel opening. The packing includes a vent hole to allow communication between the vessel interior and ambient.

4 Claims, 2 Drawing Sheets

PERFUMED URINE COLLECTION VESSEL FOR MEN AND WOMEN

BACKGROUND OF THE INVENTION

The present invention relates to a handy commode and urine vessel for men and women.

People who are bed-ridden are forced either to wear a diaper or use a handy commode when they want to discharge feces or urine. Even if they want to do this alone, there is no compact commode that can be put by the bed.

There are some handy commodes and urine vessels available, but they have many disadvantages as follows;

1) an attendant is required;

2) those for women's use often leak;

3) mode of use is limited (usually upright posture);

4) they smell bad odor;

5) they are big and often expensive;

6) some of them are used only once and then disposed.

Therefore, a convenient, handy commode and urine collection vessel has been desired for a long time, especially among women.

SUMMARY OF THE INVENTION

The aim of this invention is to provide to those who are bed-ridden a convenient, handy commode and/or urine collection vessel. The invention is specifically designed not to leak and to be used without an attendant. Furthermore, it is designed to be used ill any posture such as lying, kneeling or sitting. In addition, a perfumed sheet can be attached inside the vessel. This prevents any bad odor from disturbing the user. By using a vinyl bag, it is not necessary to clean the vessel after use. The case prepared to the vessel is neat and attractive. Thus the user can relieve him/herself comfortably.

BRIEF DESCRIPTION OF THE DRAWINGS

The invention described herein will be understood better with reference to the following drawings, of which.

Nomenclature:

| | | |
|---|---|---|
| 1 the vessel | 2 upper hole | 3 upper hole end |
| 4 side hole | 5 reinforcing rib | 6 band guide |
| 7 packing | 8 discharge hole | 9 packing edge |
| 10 packing vent | 11 upper cover | 12 upper cover edge |
| 13 side cover | 14 band | 15 ring |
| 16 ring edge | 17 vinyl bag | 18 perfumed sheet |
| 19 case | 20 case cover | 21 case handle |
| 22 case hinge | 23 perfume | 24 urine |

DETAILED DESCRIPTION OF THE INVENTION

Construction and Parts

Figure 1:
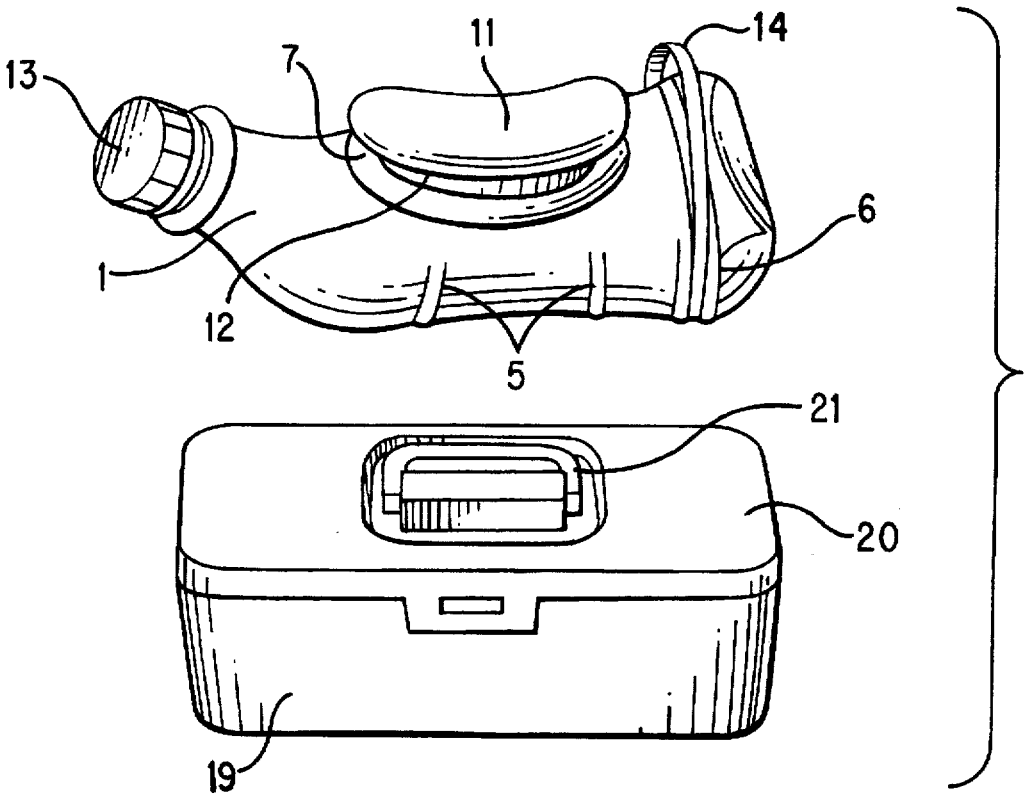
FIG. 1 is the isometric drawings of the urine vessel and it's case.
Figure 2:
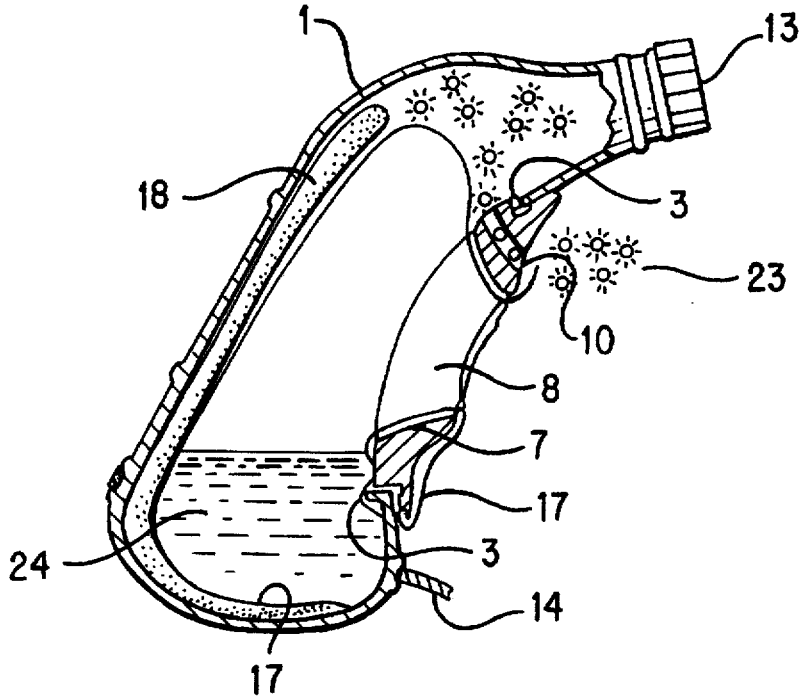
FIG. 2 shows the sectional drawing of the vessel (1) when the user is lying on his/her back. The perfumed sheet is inserted into the vessel along with the vinyl bag. As the urine collects within the vessel, perfume is ejected from the vent.
Figure 3:
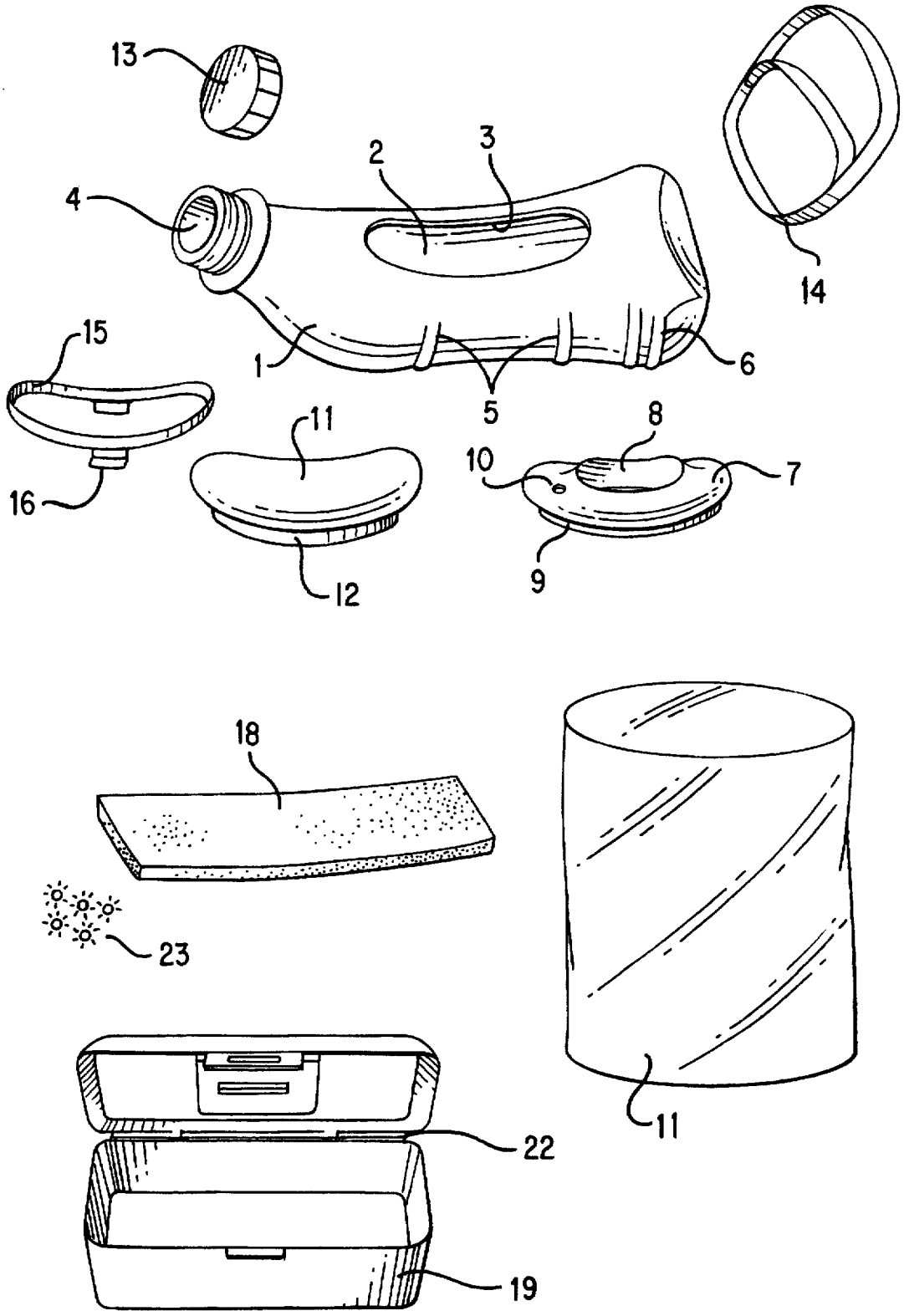
FIG. 3 is all parts drawings of the vessel and case.

The invention consists of the vessel (1) which has a form-fitting upper hole (2), shaped to fit between the thighs, and a side hole (4). The Packing (7) which is made of soft rubber is set into the upper hole (2) to seal the clearance between the body and the vessel. The packing has a packing vent (10) through which air escapes while being forced out by in-coming urine. The packing edge (9) fits securely into the upper hole edge (3). Thus leakage from the vessel is prevented by the packing. In the case of lying sideways or kneeling, the user can select the ring (15) instead of the packing (7). The ring may be used for bowel movements as well. The ring (15) has a ring edge (16) which fits into the upper hole edge (3) in the same manner as the packing edge (9). The band (14), as an attachment to the vessel, is used when lying sideways or kneeling in order to pull the vessel more closely to the body. The band (14) is set along a band guide (6) and can also be used to draw the vessel back out after use. The band also constitutes a removable carrying handle. The vessel is formed with reinforcing ribs (5) to strengthen the vessel when it is used in the kneeling position. The perfumed sheet (18) and the vinyl bag (17) eliminate any offensive odor. The perfumed sheet is inserted into the bottom of the vessel before use. After the perfumed sheet is set, the packing (7), with the vinyl bag (17) inserted from underneath and folded over the packing, is set on the upper hole (4) of the vessel. The open end of the vinyl bag is left unsecured adjacent the packing vent as illustrated in FIG. 2. Any offensive odor from urine and/or feces is kept within the vinyl bag. In accordance with the increase in volume of the vinyl bag contents, the air around the vinyl bag and the fragrance from the perfumed sheet is forced out through the packing vent. The side hole is covered with a screw-on side cover (13) when not in use.

The most important point of this invention is as follows:

1) The shape of the upper hole (2) fits closely to the body. The user of the vessel can select any posture he/she wants. No leakage at all whichever posture selected.

2) For convenience in women's use, the packing (7) or ring (15) is devised.

3) The perfumed sheet (18) can be attached if the user does not want any bad odor. In this event, a vinyl bag (17), packing (7) or ring (15) as well as the perfumed sheet are used.

4) The user can use the band (14) to fit the vessel more closely to the body.

5) The capacity of the vessel (1) is suitable for one usage.

6) An attractive case (19) is included for user's convenience.

The user of the vessel can select any posture he/she wishes. To understand in detail, consider the following.

1) Remove the vessel (1) from the case (19).

2) Take out a perfumed sheet (18), insert this into the vessel and attach it to the inside wall.

3) Also insert a vinyl bag (17) into the vessel and clamp it down with the packing (2).

4) Set the packing or ring just above the upper hole end (3).

5) Close the side cover (13) and tighten.

6) Kneel on the bed, insert vessel between the thighs with the side cover to the back.

7) Pull the band (14) tightly during discharge. The perfume will come from the the packing vent (10).

8) After discharge, remove the vinyl bag from the vessel and dispose suitably.

9) Wipe the vessel with tissue paper, if soiled, and return it to the case. The maximum capacity in this case is 1000 cc.

Thus it is possible to discharge without an attendant using this vessel no matter how incapacitated the user may be.

What is claimed is:

1. A commode for men and women comprising:

a waste collection vessel having at least one opening in a wall thereof, said wall opening shaped to conform to a user's body for receiving waste discharge;

a perfumed sheet disposed within said vessel;

an annular packing ring including an outer portion having a diameter to be sealingly received in said wall opening, and an inner portion, said packing further including a vent hole therethrough;

a liquid impervious bag disposed within said vessel, said bag having a mouth portion extending through said packing along said inner portion, said mouth portion being folded over said packing and further extending along said outer portion, said mouth portion having a terminal end portion sealingly secured in said wall opening by said packing, said terminal end portion being unsecured adjacent said vent hole to allow communication between the vessel interior and ambient.

2. The commode defined in claim 1, further comprising a second opening in said vessel and including a removable cover.

3. The commode defined in claim 1, further comprising a band releasably secured to said vessel for user manipulation.

4. The commode defined in claim 1, further comprising a case for storing and transporting said commode.

* * * * *